US005152108A

United States Patent [19]

Madl, Jr.

[11] Patent Number: 5,152,108

[45] Date of Patent: Oct. 6, 1992

[54] FOUNDATION SYSTEM WITH INTEGRAL BRACING FOR MANUFACTURING BUILDINGS

[76] Inventor: Jos. Madl, Jr., 2161 Vista Entrada, Newport Beach, Calif. 92660

[21] Appl. No.: 528,822

[22] Filed: May 24, 1990

Related U.S. Application Data

[63] Continuation-in-part of Ser. No. 405,347, Sep. 11, 1989, abandoned.

[51] Int. Cl.[5] ..... E04B 2/82

[52] U.S. Cl. ..... 52/126.1; 52/292; 52/DIG. 11; 52/126.7

[58] Field of Search ..... 52/22, 292, 299, DIG. 11, 52/169.9, 126.7; 254/98

[56] References Cited

U.S. PATENT DOCUMENTS

| | | |
|---|---|---|
| 748,946 | 1/1904 | Hansberger . |
| 2,356,941 | 8/1944 | Meyer . |
| 3,251,163 | 5/1966 | Russel . |
| 3,493,209 | 2/1970 | Brammer . |
| 3,535,956 | 12/1950 | Roggensack . |
| 3,750,349 | 8/1973 | Deike . |
| 3,826,057 | 7/1974 | Franklin . |
| 3,828,491 | 8/1974 | Koon et al. . |
| 3,837,127 | 9/1974 | McMichael et al. . |
| 3,902,289 | 9/1975 | Dashew . |
| 3,917,227 | 11/1975 | West . |
| 3,927,498 | 12/1975 | Benedetti . |
| 4,026,076 | 5/1977 | Analetto . |
| 4,037,835 | 7/1977 | Forsyth . |
| 4,102,096 | 7/1978 | Cody . |
| 4,106,256 | 8/1978 | Cody . |
| 4,122,645 | 10/1978 | Tooley . |
| 4,125,975 | 10/1978 | Soble . |
| 4,214,410 | 7/1980 | Mitsueda . |
| 4,229,919 | 10/1980 | Hughes . |
| 4,261,149 | 4/1981 | Gustafson . |
| 4,279,109 | 7/1981 | Madl, Jr. . |
| 4,348,843 | 9/1982 | Cairns et al. . |
| 4,404,780 | 9/1983 | Josephson . |
| 4,417,426 | 11/1983 | Meng . |
| 4,520,649 | 6/1985 | Barton, Sr. . |
| 4,546,581 | 10/1985 | Gustafson . |
| 4,546,591 | 10/1985 | Beltz . |
| 4,598,510 | 7/1986 | Wagner, III . |
| 4,684,097 | 8/1987 | Cox . |
| 4,793,110 | 12/1988 | Tucker . |
| 4,801,119 | 1/1989 | Pelletier . |
| 4,899,497 | 2/1990 | Madl, Jr. . |

FOREIGN PATENT DOCUMENTS

| | | |
|---|---|---|
| 251308 | 10/1924 | United Kingdom . |

*Primary Examiner*—David A. Scherbel
*Assistant Examiner*—Creighton Smith
*Attorney, Agent, or Firm*—Knobbe, Martens, Olson & Bear

[57] ABSTRACT

A plurality of spaced, rigid support pedestals that are vertically adjustable are employed to support manufactured buildings. The pedestals have a truncated pyramid or frusto-conical shape to provide both lateral and vertical support for the manufactured building. An adjustable connector between the base of the pedestal and the upper end allow the height of each pedestal to be independently varied to support the manufactured home in a dead level position. The upper ends of the support pedestals are clamped to the flanges of I-beams of the building chassis so as to prevent the building from shifting relative to the foundation.

42 Claims, 5 Drawing Sheets

FIG. 9
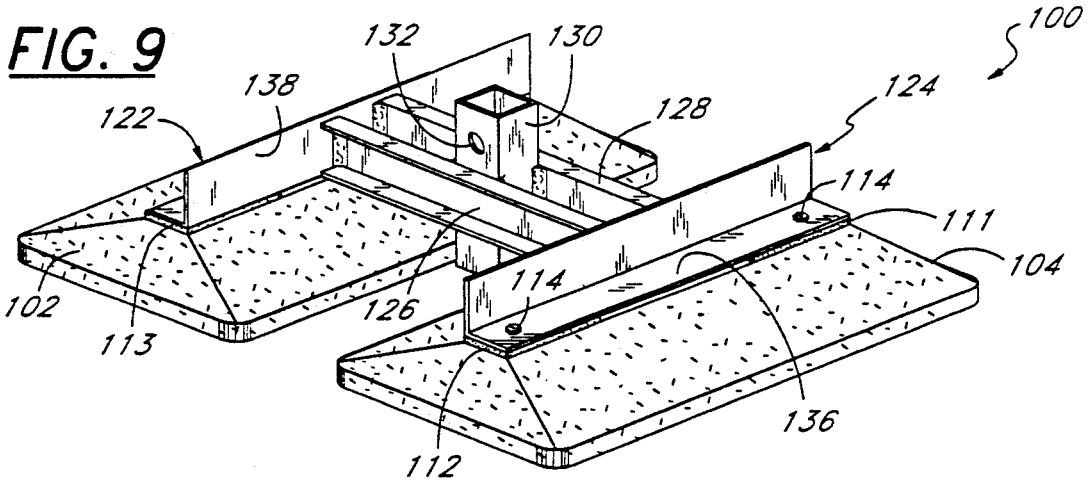
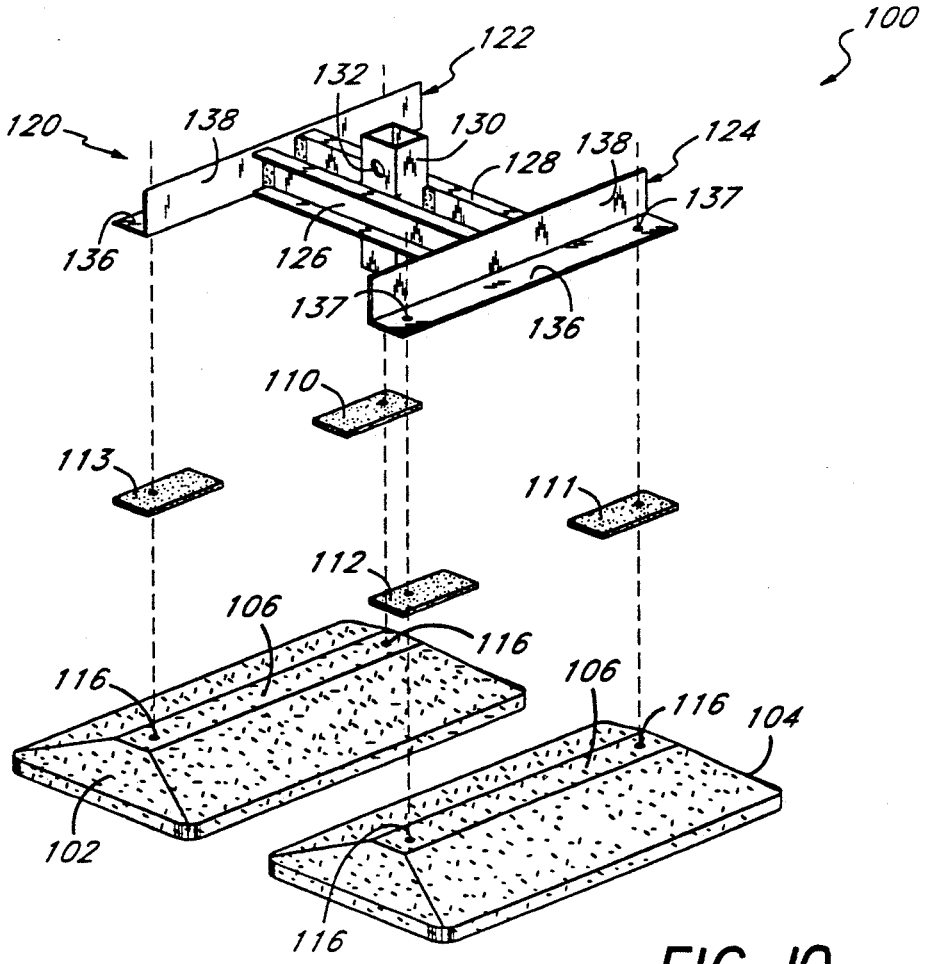
FIG. 10

FOUNDATION SYSTEM WITH INTEGRAL BRACING FOR MANUFACTURING BUILDINGS

CROSS REFERENCE TO RELATED APPLICATIONS

This is a continuation-in-part of the U.S patent application Ser. No. 07/405,347 entitled "FOUNDATION SYSTEM WITH INTEGRAL BRACING FOR MANUFACTURED BUILDINGS" filed on Sep. 11, 1989 now abandoned.

FIELD OF THE INVENTION

The present invention relates to foundation systems for supporting manufactured buildings, and more particularly, to a foundation system capable of withstanding high external forces caused by dangerous earthquakes and high winds, thus preventing damage to the home or injury to its occupants.

BACKGROUND OF THE INVENTION

Several types of mobile home or manufactured building support systems are known in the prior art. Usually, such buildings are supported by light gauge metal piers or stanchions. Concrete blocks or pads are also often used to support manufactured buildings. Typically, the building is towed to the site and placed on piers or blocks aligned under the frame of the mobile home. These support systems, as well as other similar support systems rely solely upon the compressional force or weight of the mobile home to hold it on the pier. These piers are extremely unstable when subjected to lateral or horizontal movement, and thus such systems allow shifting of the mobile home, particularly during earthquakes or high winds, whereby the mobile home moves and falls off the support. This can result in its piers piercing the flooring of the building, causing external damage both to the structure itself and utility connections. Similarly, concrete block support systems provide little protection against lateral forces.

Various other support systems have attempted to restrain the mobile home from shifting. One such system is disclosed in U.S. Pat. No. 4,214,410 which uses a plurality of stanchions connected together by a plate which would receive the wheel drum of the mobile home so that the lugs on the wheel drum could be affixed to the plate. However, many mobile homes, particularly those without wheels, cannot be supported in such a way.

Another type of support system is disclosed in U.S. Pat. No. 4,261,149 which has pedestals aligned under the support beams of the mobile home and braced in perpendicular directions. The problem with this system, and others known in the prior art, is that the system must be specially fitted to each mobile home, a time consuming and laborious task usually done at the site. Moreover, that system presumes that it will rest on a substantially level earth surface, and also fails to take into account uneven settling of the earth surface caused by the home after it has been installed onto the system.

Other types of support systems have attempted to solve the problems caused by uneven and settling earth surfaces. For example, U.S. Pat. No. 4,417,426 discloses in FIG. 6 a vertically adjustable foundation system. However, an adjustment requires disconnecting the crossbracing of the pedestal supports. Moreover, because the adjustment requires reconnecting the cross members, the vertical increments are not variable, but extremely limited. The adjustment procedure is difficult to perform at the site.

Other support systems for manufactured buildings include more permanent supports which utilize concrete pads or footings buried in the surface of the earth. For example, blocks, piers or support members are often mounted in and on concrete footings buried several feet under the surface. While these support systems provide some lateral support for the manufactured building, they are very expensive and require more time before a building may be placed on such a system. The time and expense required are increased significantly because the labor and material costs are greater; government inspections are required for buried footings; and such systems are often tailored to the particular manufactured building.

Another problem with pedestals presently available is the need to periodically readjust the height of the pedestals once they have been installed. The height of the pedestal, especially with shims and piers, is often affected by vibrational forces such as the wind and traffic. The lack of resistance by the pedestals to these vibrational forces necessitates the periodic re-leveling of the entire manufactured building which typically includes the adjustment of several pedestals. Such re-leveling can be very costly and time consuming.

Thus, there remains a need for an effective foundation system which can withstand earthquake and high wind forces and still have sufficient adjustability to account for varying earth surfaces. Further, such a system should provide for leveling, resistance to vibrational forces and the integration of all components to act as a single unit. In addition, there is a need for a foundation system which can be economically manufactured off the site and which minimizes the time and effort required to install the system at the site.

SUMMARY OF THE INVENTION

Briefly stated, the foundation system of the present invention utilizes a plurality of specially formed pedestals which provide support against lateral forces as well as vertical forces. The plurality of pedestals act together as a unit to support the manufactured building and compensate for any inconsistency in the levels of the surface upon which the pedestals are placed. The pedestals and the I-beam chassis of the manufactured building are interconnected to form a single unit which operates as a foundation system that offers a myriad of possible height adjustments. In a preferred embodiment of the invention, the pedestals have a truncated pyramid or frusto-conical shape with an enlarged base or pad to provide the added lateral support. The bottom of the pedestals are also textured and provide friction which further resists lateral movement. The pedestals have vertically adjustable connectors which allow each pedestal to individually compensate for variations in the level of the surface upon which the manufactured building is placed. An upper portion and a clamp attach the pedestals to the chassis of the manufactured building. With this arrangement, the pedestals can be adjusted to accommodate different levels of terrain and the upper portions of the pedestals engage the I-beam frame of the manufactured building to retain the manufactured building in a dead level position. The clamps are employed to secure the upper portion of the pedestals to the I-beams to prevent separation of these components during earthquake or wind forces. This basic assembly can be used as a support beneath existing manufactured buildings as well as new ones. Advantageously, these components are factory manufactured and factory pre-assembled to precise tolerances requiring minimal field connection at the building site.

In its preferred form, the adjustable connector for each pedestal includes a threaded member rigidly engaging a connecting member. The threaded member cooperates with the threaded portion of the connecting member to provide a gradual adjustment in the height of the pedestal. The connecting member is also attached on its opposite end to the base in a manner that allows the pedestal to be positioned at several different preset heights.

In another embodiment, the pedestal comprises a first base, a second base, an intermediate weight distributing frame, the adjustable connector, and the upper portion. In this embodiment, the first and second bases and the intermediate frame effectively replace the enlarged base of the preferred embodiment since the adjustable connector and the upper portion are identical to those in the preferred embodiment. The first and second bases are preferably identical and have a generally frustum shape. In an exemplary form, the intermediate frame is H-shaped and comprises two L-shaped members, two C-shaped brackets and a square tube. The members are placed on spacers located on top of the first and second bases to evenly distribute the force over the bases. The brackets interconnect the members and attach the square tube in a center area above and between the first and second bases. The square tube is sized to mate with the adjustable connector, and thus, permits attachment of the intermediate support member to the manufactured building. This embodiment is particularly advantageous because it retains the capabilities to resist vertical and lateral forces of the preferred embodiment while having a component form which makes the pedestals easier for workmen to transport and position.

In accordance with the present invention, a plurality of pedestals are provided to support each I-beam beneath the manufactured building. Each pedestal is located to evenly distribute the weight of the building. With the pedestals aligned under the I-beams, the adjustable connectors compensate for height variations in the surface and maintain the building in a dead level position. The upper portions of the pedestals are then clamped to the flanges of the I-beam beneath the structure. The height of the pedestals can always be further adjusted as necessary due to any subsequent earth settling.

BRIEF DESCRIPTION OF THE DRAWINGS

FIG. 9 is a perspective view of a third embodiment for the pedestal of the foundation system of the present invention; and FIG. 10 is an exploded perspective view of the third embodiment for the pedestal of the foundation system of the present invention.

DETAILED DESCRIPTION OF THE PREFERRED EMBODIMENT

Figure 1:
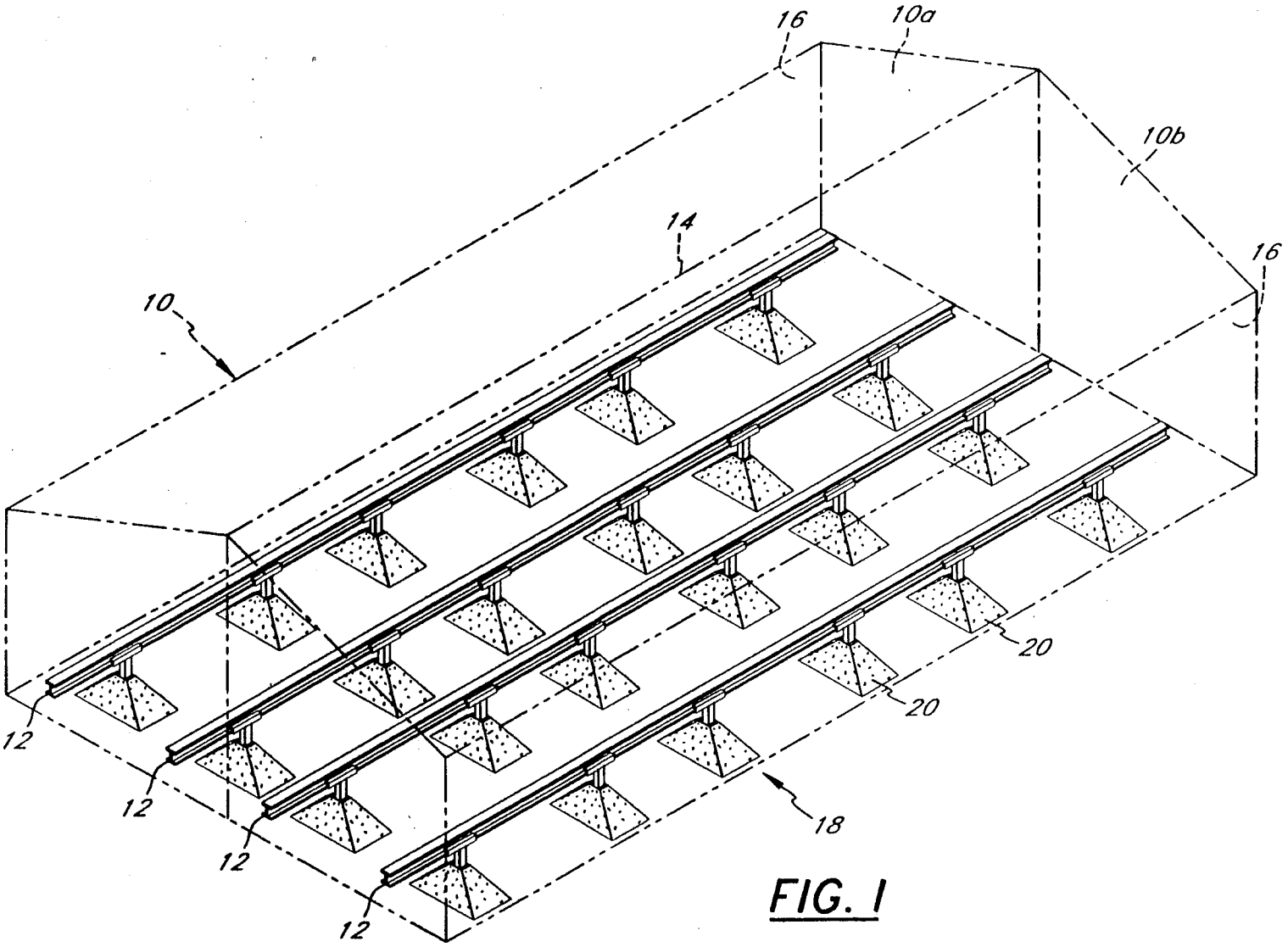
FIG. 1 is a perspective view of the foundation system of the present invention in relation to supporting I-beams and a manufactured building indicated in broken lines.

In FIG. 1, the general configuration of a foundation system 18 made according to the present invention is shown. Broken lines in FIG. 1 indicate a manufactured building 10, which is generally constructed and assembled with a frame of I-beams 12 in a factory and delivered to a particular site for placement upon the foundation system 18. Typically, the manufactured building 10 is formed of two integrated rectangular sections 10*a* and 10*b* that are from 10 to 14 feet wide so that they can be transported on highways. These sections 10*a* and 10*b* are joined at the building site along the plane formed by the centerline line 14 midway between the longitudinal sides 16 of manufactured building 10. Attached to the manufactured building 10 is a chassis made from parallel I-beams 12 equally spaced along the bottom of the manufactured building 10. Generally, the I-beams 12 extend the entire length of the manufactured building 10.

In the foundation system shown a plurality of pedestal assemblies 20 provide a substructure supporting the I-beams 12 of the manufactured building 10. Six of such pedestal assemblies 20 are shown spaced apart at substantially equal distances along each I-beam 12. FIG. 1 illustrates the foundation system 18 of the present invention which, typically, utilizes a total of twenty-four pedestal assemblies 20 to support the manufactured building 10.

Referring to FIGS. 2-5, the pedestal assembly 20 comprises a base 22, an adjustable connector 24 and an upper portion 26. Additionally, a clamp 28 is provided to join the upper portion 26 and the I-beam 12 together as will be discussed below. The base or pad 22 of the pedestal assembly 20 is the portion that contacts the terrain of the earth's surface. Connected to and extending upwardly from the base 22 is the adjustable connector 24. The adjustable connector 24 allows the height of the pedestal assembly 20 to be varied to compensate for the uneven terrain of the earth's surface. The upper portion 26 is connected above the adjustable connector 24 and provides a platform upon which the chassis of the manufactured building 10 rests.

The base 22 has a frustum shape which can have a substantially truncated pyramid or frusto-conical shape. In an exemplary embodiment, the base 22 of the pedestal assembly 20 is 9" high, and 24" wide and 38" long at its bottom. The top of the base 22 is 6" wide and 8" long, and thus, the bottom is several times greater in area than the top. The preferred angle formed by the bottom and the sides of the base 22 is about 45 degrees for the width sides and 30 degrees for the longitudinal sides. The shape of the base 22 provides the added lateral support absent in the prior art for preventing damage from earthquakes and high winds.

Advantageously, the bottom of the base 22 is also textured which creates friction between the base 22 and the ground to resist movement in the lateral direction. The base 22 may also be positioned so that the bottom of the base is a few inches beneath the surface of the earth to prevent movement in the lateral directions. Such positioning advantageously provides a great amount of resistance to lateral forces and does not significantly increase the expense and amount of time to assemble the foundation system of the present invention.

Figure 4:
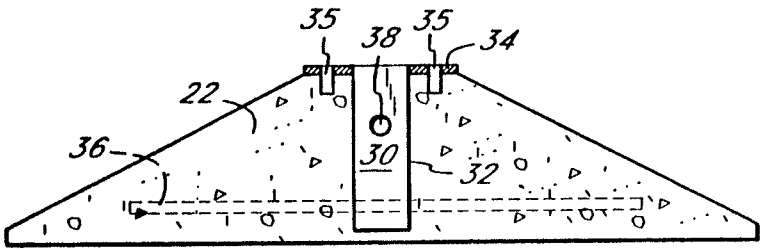
FIG. 4 is a cross-sectional side view of a preferred embodiment of the base of the pedestal assembly taken along line 4—4 of FIG. 2.
Figure 3:
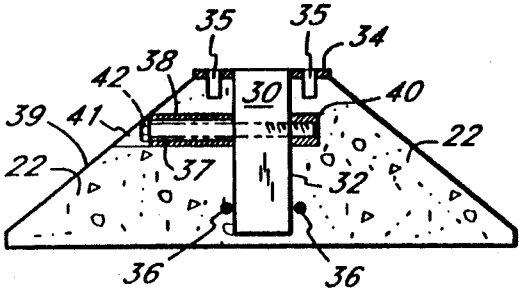
FIG. 3 is a cross-sectional side view of a preferred embodiment of the base of the pedestal assembly taken along line 3—3 of FIG. 2.

A rectangular cavity 30, as seen in FIGS. 3 and 4, is located at the center of the top of the base 22 and extends downward to the bottom of the base 22. The cavity 30 houses an outer square tube 32 that connects the base 22 to the adjustable connector 24. A plate 34 is attached to the upper end of the outer tube 32. The plate 34 is also fastened to the base 22 and distributes the force from the weight of the manufactured building 10 over the base 22. A similar function is performed by a pair of bars 36. As shown in FIG. 3 and in FIG. 4 by phantom lines, the bars 36 are located at approximately one quarter of the height of the base 22 and are positioned longitudinally parallel to the sides of the base 22. The bars 36 are welded to the outer square tube 32 and provide added reinforcement to the base 22. The bars 36 also help to distribute the force applied to the pedestal assembly 20.

Figure 2:
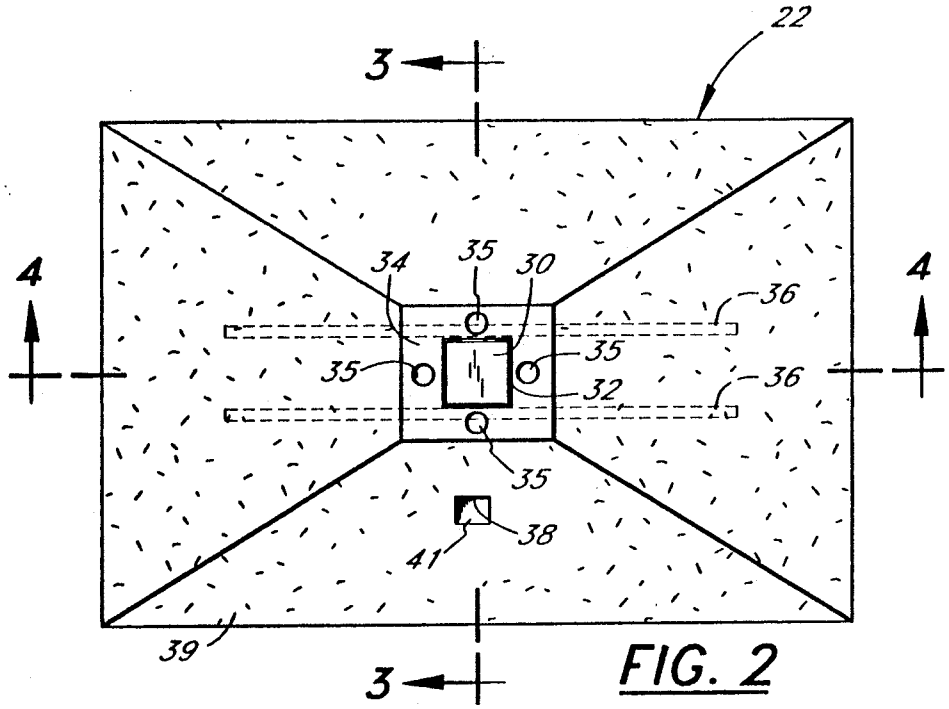
FIG. 2 is a top view of a preferred embodiment of the base of the pedestal assembly of the present invention.

Additionally, there are four holes 35 in the plate 34 which extend as cylindrical cavities downward into the base 22. As shown in FIG. 2, there is a hole 35 is centered between the outer tube 32 and the sides of the base 22 in the four outward directions from the sides of the outer tube 32. The interior of each hole 35 is threaded to receive bolts or screws. This allows added structural support to be provided to the manufactured building 10 by attaching supports between the base 22 and the manufactured building 10. Thus, these holes 35 allow the base 22 to provide additional lateral and vertical support if needed.

The base 22 also has a bore 38 entering from one side 39 near the top. The bore 38 runs inward from one side 39 of the base 22 and ends at a position sightly beyond the outer tube 32. The side 39 has a portion 41 cut away to accommodate a pin or bolt 42 that is insert into the bore 38. The cutaway portion 41 does not significantly affect the structural strength of the base 22 and keeps the pin 42 flush with the base 22 so that it does not extend beyond the plane formed by the side 39. The bore 38 is perpendicular to the outer tube 32 and parallel to the plane formed by the bottom of the base 22. At the innermost position in the bore 38, a nut 40 is imbedded in the base 22. The nut 40 is threaded to engage with the pin 42 through the bore 38. A guiding tube 37 is attached inside a portion of the bore 38. The guiding tube 37 aligns the pin 42 to guide it through the base 22 and the outer tube 32 to the nut 40. The guiding tube 37 houses the pin 42 (shown in phantom) that mates with both the outer tube 32 and the adjustable connector 24, and is secured by the nut 40. The adjustable connector 24 includes a inner square tube 46. The inner square tube 46 is sized to fit snugly within the outer tube 32. Along opposite sides of the inner square tube 46 there is a series of holes 48 along a vertical axis that may be aligned to position the pedestal assembly 20 at one of various preset heights. For example, to position the pedestal assembly 20 at any height the pin 42 enters the bore 38 and extends through the side of the outer tube 32, the side of the inner square tube 46, the opposite side of the inner square tube 46, the opposite side of the outer tube 32, and then engages the nut 40 imbedded in the base 22. The height of the pedestal assembly 20 can be adjusted to preset values by removing the pin 42, positioning the inner square tube 46 within the outer square tube 32 at the desired height, and reinserting the pin 42 through the holes 48 that were previously above or below the pin 42. Thus, the pin 42 allows the pedestal assembly 20 to be adjusted to various vertical heights as desired since the adjustable connector 24 can be secured at a variety of heights with the pin 42. The unique construction of the base 22 in the above described manner advantageously allow for a reduction in the overall height of the pedestal assembly 20. Thus, the preferred embodiment of the present invention provides low rise supports in as shallow a space as possible which adds to the attractiveness of the pedestals 20.

In a preferred embodiment, the base 22 is advantageously constructed of light weight, high strength, reinforced concrete. The use of such material provides greater durability and strength than metal piers known and used in the art. Additionally, the use of concrete eliminates the need to add any special materials to make the pedestal assemblies 20 fire or water resistant. Moreover, the configuration of the present invention makes the manufacture of pedestal assemblies 20 easier and more economical. The above configuration of the components within the base 22 allows for unitary construction of the pedestal assembly 20. A mold with the shape of an inverted base 22 is used to construct the base 22. Since the outer square tube 32, the guiding tube 37, the upper plate 32, and the bars 36 are attached together, they can be placed in the mold so that concrete may be poured over them for easy and economical construction of the base 22 of the pedestal assembly 20. As the concrete is poured in the mold, a rough texture automatically forms on the top of the concrete in the mold. This is advantageous since the top of the concrete becomes the bottom of the base 22 once the mold is removed. The construction of the base 22 as described also allows for volume production of the pedestals of the present invention at off site facilities, such as a cement plant. While concrete is the preferred material for the base 22, it should be understood that other materials such as fiberglass or plastics may be used to construct the base 22.

Figure 6:
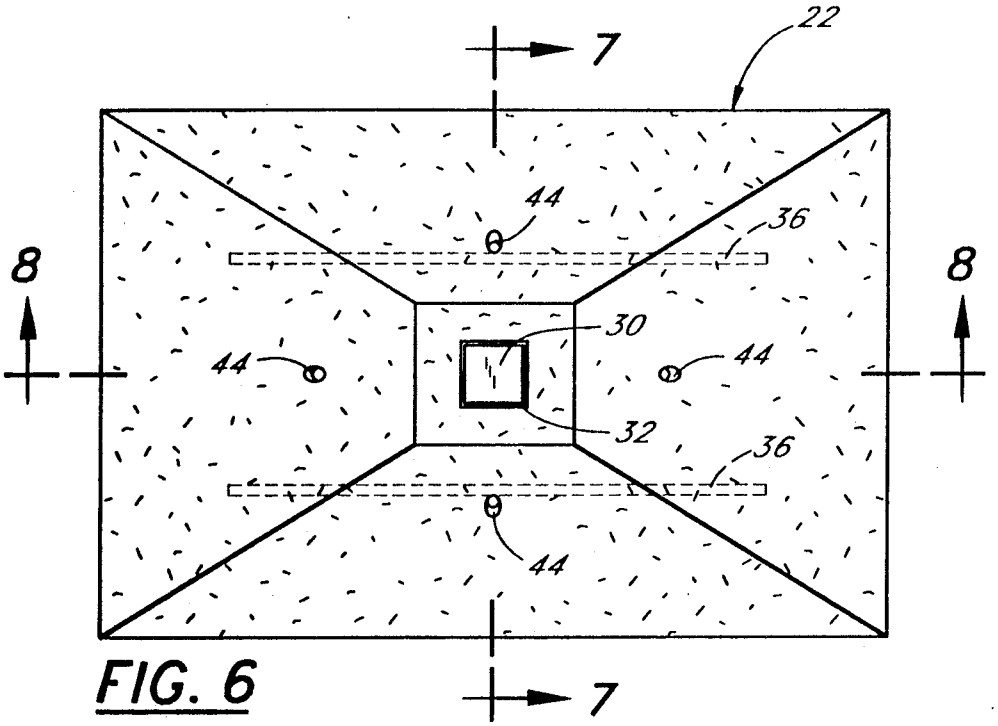
FIG. 6 is a top view of an alternate embodiment of the base of pedestal assembly of the present invention.
Figure 8:
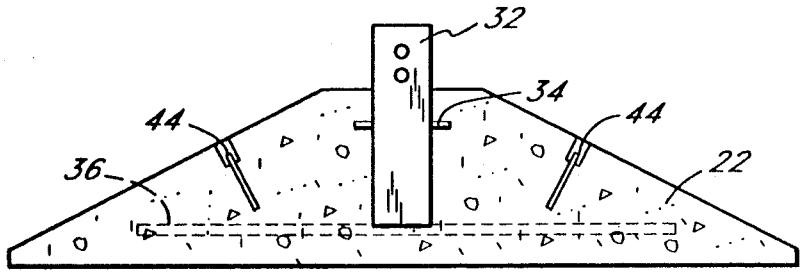
FIG. 8 is a cross-sectional side view of the alternate embodiment of the pedestal assembly taken along line 8—8 of FIG. 6.
Figure 7:
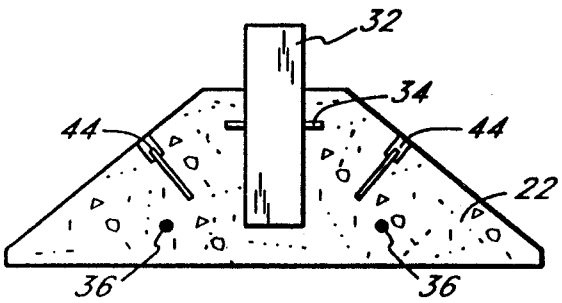
FIG. 7 is a cross-sectional side view of the alternate embodiment of the base of the pedestal assembly taken along line 7—7 of FIG. 6.

Referring to FIGS. 6–8, an alternate embodiment of the present invention will be described. For ease of understanding, like parts have been labelled with the same numbers. The shape of the base 22 in FIGS. 6–8 is virtually identical to that of FIGS. 2–4. However, in the alternate embodiment there is no bore 38 and cutaway section 41. The outer tube 32 extends above the top of the base 22 as shown in FIGS. 7 and 8. The extended portion of the outer tube 32 provides an area for the pin 42 and nut 40 to hold the base 22 and the adjustable connector 24 together, and therefore, the need for the bore 38 and cutaway section 41 used in the embodiment of FIGS. 2–4 is eliminated. Another notable difference is the placement of the plate 34 and bars 36. The plate 34 is inside the base 22, as opposed to on top, and extends perpendicularly outward from the outer tube 32 into the base 22 to provide added structural support. The bars 36 have the same general position, but are located away from the outer tube. However, it should be noted that the bars 36 could be welded to the outer tube 32 as in the embodiment of FIGS. 2–4.

Figure 5:
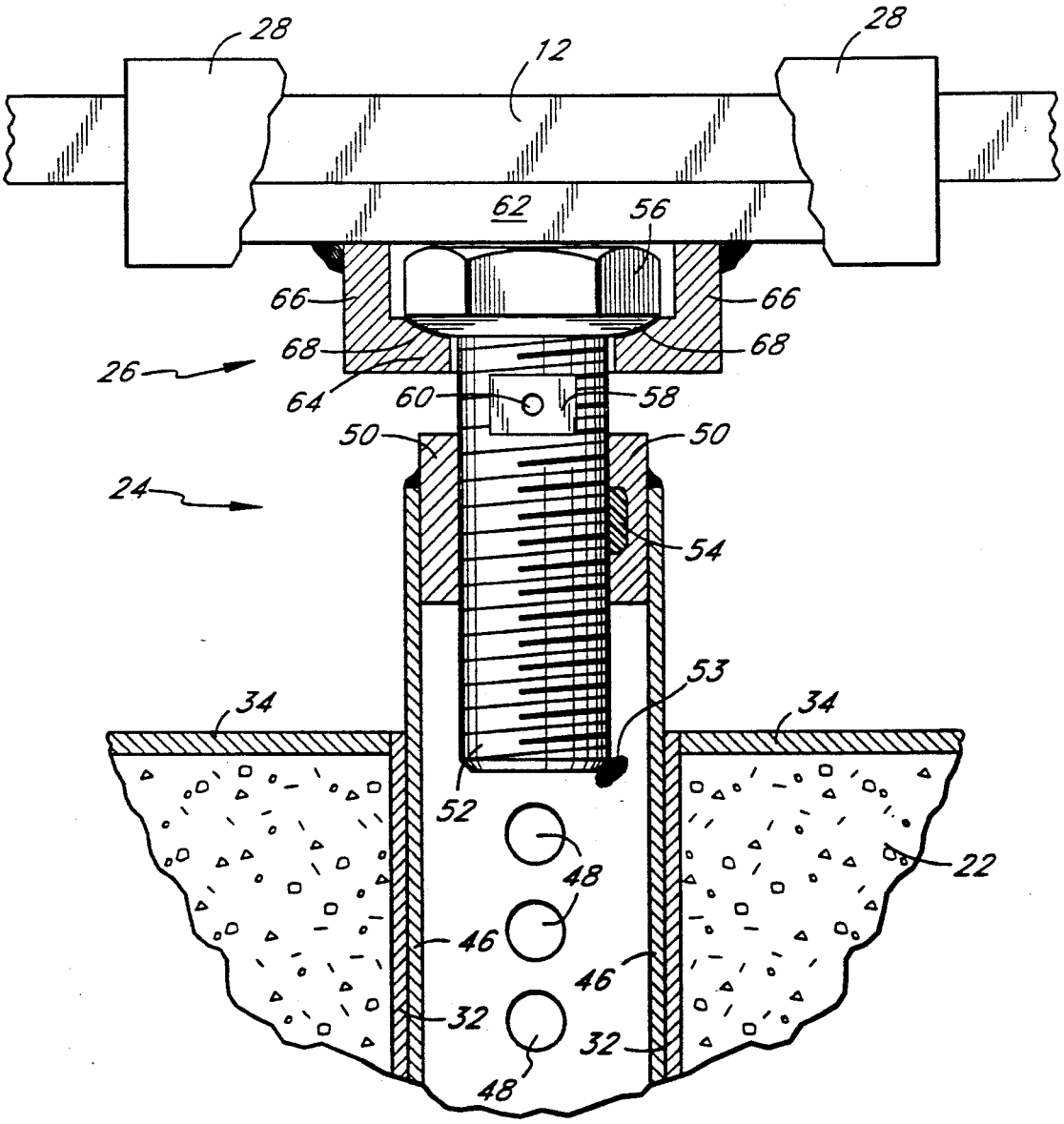
FIG. 5 a side view, partially in section of the base, the adjustable connector and the upper portion of the pedestal assembly of the present invention and an I-beam connected thereto with a clamp.

The embodiment of FIGS. 6–8 also provides a ferrule loop insert 44 at a substantially center position on each side of said base 22. The ferrule loop inserts 44 are inside of the base 22 and perpendicular to the plane formed by the respective sides into which the ferrule loop 44 are inserted. These ferrule loop inserts 44 are use to provide added lateral support to the building since additional supports can be mounted to the base 22 using the inserts 44. It should be noted that this feature as with other configurations and features may be interchanged with their equivalents shown in the embodiment of FIGS. 2–4. With reference to FIG. 5., the adjustable connector 24 comprises a square nut 50, a bolt 52 and a polymer patch or lock washer 54, in addition to the inner square tube 46 described above. The connector 24 is connected between the base 22 and the upper portion 26, and permits fine variations in the height of the pedestal assembly 20 by increasing or reducing the connector length. As illustrated in FIG. 5, the square nut 50 is sized to fit securely within the upward end of the inner square tube 46 and is attached in that position. The square nut 50 is threaded to mate with the bolt 52 thereby allowing for gradual and fine adjustments in the height of the pedestal assembly 20 in addition to the height adjustments provided by the position of the inner square tube 46 with respect to the outer square tube 32. The bottom or engaging end of the bolt 52 has a tack weld 53 to prevent the bolt 52 being completely unscrewed from the square nut 50 of the adjustable connector 24. As seen in FIG. 5, the bolt 52 lies along the same vertical axis as the inner 46 and outer 32 tubes. On the uppermost end of the bolt 52 there is a head 56. The head 56 connects the bolt 52, and therefore the adjustable connector 24, with the upper portion 26. Just below the head 56 of the bolt 52 a pair of flats 58 are machined into opposite sides of the bolt 52 to permit the use of a wrench to turn the bolt 52 to vary the height of the pedestal assembly 20. The flats 58 are advantageously sized to provide sufficient torque to rotate the bolt 52 while covering only the minimal amount of the vertical space necessary to maximize the vertical adjustment possible by turning the bolt 52. The flats 58 are capable of receiving the torque necessary to raise or lower the manufactured home 10. Thus, the flats 58 also allow the height of the pedestal assembly 20 to be adjusted at anytime with or without using a jack.

Once the pedestal assembly 20 has been positioned at a particular height, the pedestal assembly 20 should remain at that height to keep the manufactured building 10 level. The present invention advantageously includes a polymer patch on the square nut 50 to assure that the bolt 52 does not slip and retains the pedestal 20 at the properly adjusted height. This is particularly advantageous because it makes the adjustable connector 24 resistant to vibrational forces from the wind or the ground settling which may affect the height of the connector 24. Alternatively, a lock wire hole 60 may be drilled through the bolt in the center of the flats 58 to prevent the bolt 52 from rotating.

Finally, the upper portion 26 as seen in FIG. 5 comprises a plate 62 and a bolt retainer 64. The plate 62 is used to provide a surface upon which the I-beams 12 of the manufactured building 10 can rest. The plate 62 is sized to be equal to the width of I-beams 12 so that the plate 62 may be fastened to the I-beam 12 with means known in the art such as the clamp 28. While the plate 62 is described for use with an I-beam 12, it should be understood to one skilled in the art that the plate 62 can be made to attach to other types of beams, support structures, flush bottoms or any other floor systems. The bolt retainer 64 is a U-shaped channel attached below the plate 62 and connecting the upper portion 26 to the adjustable connector 24. The legs 66 of the bolt retainer 64 extend upward and are welded to the plate 62. The head 56 of the bolt 52 is retained in the U-shaped channel formed by the bolt retainer 64. More particularly, the head 56 of the bolt 52 is encapsulated in the bolt retainer 64 so that the head 56 resists movement in both the vertical direction and all 360 degrees of lateral direction. At the bottom of the bolt retainer 64, there is an opening through which the bolt 52 extends and connects with the square nut 50. Near the opening, the edges 68 of the opening are advantageously beveled. This allows the plate 62 to be positioned at angles less than perfectly level or perpendicular to the bolt 52 without damaging the pedestal assembly 20. This is significant since rarely is the system 18 of pedestal assemblies 20 perfectly level after the initial placement of the building 10 on the foundation system 18. Adjustment is almost always required. Additionally, it should be noted that the adjustable connector 24 and the upper portion 26 are interconnected, and therefore, resist both upward lifting forces as well as downward gravitational forces.

Having described the invention in connection with certain preferred embodiments thereof, it will be understood that many modifications and variations thereto are possible, all of which fall within the true spirit and scope of this invention. For example, as illustrated in FIG. 9, a third embodiment for a pedestal assembly 100 has a lower portion that comprises a first base 102, a second base 104, four pads or spacers 110–113 and an intermediate support frame or weight distribution frame 120. The pedestal assembly 100 also comprises a clamp (not shown) and an adjustable connector (not shown) similar to the clamp 28 and the adjustable connector 24 described above for use in the embodiment of FIGS. 2–5 to attach the assembly 20 to the I-beams of the manufactured home. The pedestal assembly 100 can carry a vertical load and resist lateral movement equally as well as the FIGS. 2–4 embodiment, however, the third embodiment advantageously achieves such resistance with less material and a three part configuration of the first base 102, the second base 104, and the intermediate support frame 120. The three part configuration is particularly advantageous because any of the components may be transported and positioned by a single workman. This allows the components to be transported, by hand if necessary, to the point where the pedestal 100 will be positioned, and then the first base 102, the second base 104, and the intermediate support frame 120 may be assembled on site.

In comparing the embodiment shown in FIGS. 2–4 to the embodiment illustrated in FIGS. 9–10, it is readily apparent that the lower portion is similar to the enlarged base 22 of the preferred embodiment and both provide high resistance to vertical and lateral forces. In particular, the enlarged base 22 covers approximately the same area as the first and second bases 102, 104 combined. Additionally, the angles of the sides of the bases 22, 102, 104 with respect to the bottom are similar for both embodiments. Both embodiments also position the square tube 32, 130 near the top central area of the lower portion. Thus, the third embodiment reduces the amount of material required for the lower portion by replacing the enlarged base 22 of the preferred embodiment with the smaller first and second bases 102, 104 and the intermediate support member 120. It is the relatively flat shape of the lower portion and the enlarged base 22 that provides the pedestals 12, 100 of the present invention with their superior lateral support.

As best shown in FIG. 10, the first and second bases 102, 104 are advantageously made identical so that the bases 102, 104 may be mass produced. The bases 102, 104 have a generally rectangular frustum shape with the length of the bases 102, 104 being much greater than their width. For example, the bottom of each base 102, 104 is 30" by 16"; a top 106 of each base 102, 104 is 24" by 3"; and the height of the bases 102, 104 is 3.5" in a preferred size. The angle between the sides and the bottom of the bases 102, 104 preferably ranges from 25 to 50 degrees irrespective of the dimensions for the bases 102, 104. The bottom of the bases 102, 104 may also be textured as in the preferred embodiment to further prevent lateral movement of the bases 102, 104.

Additionally, it should be noted that the bases 102, 104 are formed of light weight concrete capable of with standing 3000 psi of pressure. The bases 102, 104 of the third embodiment are particularly advantageous because of their size and weight. These bases 102, 104 do not require machinery to be moved and can be lifted by workmen for proper placement. While there are illustrated only two bases 102, 104, it should be understood that several bases could be used together to bear a greater amount of vertical and lateral force.

On the top side 106, each base 102, 104 has two vertical holes 116 sized to receive a bolt 114 that connects the bases 102, 104 to the intermediate support frame 120. The holes 116 are positioned on the longitudinal axis of the bases 102, 104 with the two holes 116 spaced about 20" apart with each hole 116 being located about 2" from opposite ends of the bases 102, 104. The holes 116 may include a receiving tube (not shown) affixed therein and threaded to engage the bolt 114, and thereby securely fasten each base 102, 104 to the intermediate support frame 120. Also a concrete screw may be used instead of a bolt 114 to connect the frame 120 to the bases 102, 104. Such a concrete screw would eliminate any need for a receiving tube.

The frame 120 interconnects the first and second bases 102, 104 and also connects these bases to the adjustable connector (not shown). The frame 120 preferably comprises a pair of elongated angle irons or members 122, 124 having an L-shape or angled cross-section, a pair of brackets 126, 128 having a C-shaped cross-section, and a center tube 130, that are welded together to form a substantially H-shaped unit which transfers the vertical and lateral forces applied to the center tube 130 to the bases 102, 104. The L-shaped members 122, 124, C-shaped brackets 126, 128 and the center tube 130 are preferably constructed of hardened steel.

The L-shaped members 122, 124 are preferably sized to fit on the top 106 of the bases 102, 104, and in an exemplary embodiment are 3"×3.25"×22". A horizontal portion 136 of the L-shaped members 122, 124 is sized to cover a substantial portion of the top 106 of the base 102, 104. The horizontal portion 136 also has a pair of holes 137 corresponding to the holes 116 in the top 106 of the bases 102, 104. These holes 137 receive bolts 114 and fasten the L-shaped members 122, 124, and thus, the intermediate support frame 120 to the bases 102, 104.

Two of the shock absorbing spacers 110–113 are preferably positioned between each horizontal portion 136 of the L-shaped members 122, 124 and its respective base 102, 104. In an exemplary embodiment, the spacers 110–113 are made of heavy neoprene or a plastic sheet approximately 0.25" thick. The spacers 110–113 have a generally rectangular shape and are sized to cover a portion of the top 106 of the bases 102, 104 near opposite longitudinal ends. The spacers 110–113 preferably have holes to accommodate the bolt 114 that is inserted through the spacers 110–113 to hold the intermediate support frame 120 and the bases 102, 104 together. The spacers 110–113 are held in place by the pressure between the intermediate support frame 120 and the bases 102, 104. Although it is not necessary, adhesive may be used to secure the spacers 110–113 in place. The spacers 110–113 advantageously equalize the load on the concrete bases 102, 104 and thereby reduce the possibility of damaging the bases 102, 104 by excessive pressure on a particular area of the base 102, 104 that may protrude from the top 106. In particular, the spacers 110–113 adjust the application of force upon each base 102, 104 to the areas where the spacers 110–113 are located, and prevent the bases 102, 104 from bending or possibly cracking at the center. The spacers 110–113 are also advantageous because they conform to the surface of the bases 102, 104 and the intermediate support frame 120 to evenly distribute the vertical load over the two bases 102, 104.

Each of the L-shaped members 122, 124 also has a vertical portion 138. The vertical 138 and horizontal 136 portions are integrally connected along a longitudinal edge to form the L-shaped members 122, 124. The vertical portions 138 are preferably connected to the longitudinal edge of the horizontal portion 136 closest to the other base 102, 104. For example, for the L-shaped member 122 attached to the first base 102, the vertical portion 138 is attached along the longitudinal edge of the horizontal portion 136 closest to the second base 104. Similarly for the second base 104, the L-shaped member 124 has an opposite orientation from the other L-shaped member 122. The vertical portions 138 of the L-shaped members 122, 124 provide additional strength to the members 122, 124 themselves as well as an area to connect the two L-shaped members 122, 124 together.

The intermediate support frame 120 preferably has two C-shaped brackets 126, 128 to rigidly connect the L-shaped members 122, 124, and thus, the bases 102, 104 together. In the exemplary embodiment, the C-shaped brackets 126, 128 are 2"×3"×2"×19". On opposite longitudinal ends, each C-shaped bracket 126, 128 is advantageously attached to the L-shaped members 122, 124. The C-shaped brackets 126, 128 are attached in a position perpendicular to the plane through the vertical portion 138 of the L-shaped members 122, 124. The brackets 126, 128 are preferably welded near the center of the vertical portions 138 of the L-shaped members 122, 124. The brackets 126, 128 are parallel to each other and spaced approximately 2.5" apart. The use of C-shaped brackets 126, 128 is advantageous because they provide the added support and strength necessary to withstand the vertical and lateral load of the manufactured building.

In the center of the two bases 102, 104 and the intermediate support frame 120, the square tube 130 is attached. The square tube 130 is positioned in the center so that the downward vertical forces and the lateral forces are equally distributed between the first and second bases 102, 104. The square tube 130 is welded between the two C-shaped brackets 126, 128 such that the longitudinal axis of the tube 130 is perpendicular to the longitudinal axes of the C-shaped brackets 126, 128.

In an exemplary embodiment, the square tube 130 has a perimeter of 10", a length of 8", and walls of 12 gauge steel. The tube 130 is preferably attached so that it extends about 2.5" upward beyond the C-shaped brackets 126, 128. This advantageously provides the pedestal with a relatively small height of 9". On opposite walls of the tube 130, a hole 132 is defined. For example, the hole 132 may be 0.75" in diameter. Preferably, the hole 132 is sized to receive the pin 42 that provides large incremental adjustment of the height of the adjustable connector 24. The tube 130 is advantageously sized to receive and closely fit with the adjustable connector 24 of the preferred embodiment shown in FIG. 5. In particular, the tube 130 is designed for a close fit with the inner square tube 46 of the connector 24 of the embodiment of FIGS. 2–5. The tube 130 interacts with the connector 24 in the same manner as does the outer tube 32 described above with reference to other embodiments. Therefore, the mating of the tube 130 and the inner tube 46 will not be discussed here to avoid redundancy. The engagement of the tube 130 with the connector 24 advantageously allows the upper portion 26 and the clamp 28 to be used with the third embodiment.

It should be noted that while the intermediate support frame 120 has been described in detail above as being a H-shaped structure, the precise configuration of the intermediate support frame 120 may take many different forms so long as the intermediate support frame 120 has the strength to support the manufactured building and mates with the connector 24.

In prototype testing of the foundation system described, very satisfactory results have been obtained. More specifically, Converse Consultants of Orange County, Calif., geotechnical engineers, has expressed the opinion that, based on tests performed by Smith-Emery Company of Los Angeles, Calif., the foundation system disclosed herein is expected to perform satisfactory in supporting manufactured housing units. The system provides satisfactory vertical and lateral support. Further, the report indicates that the system is satisfactory when the present concrete pads are simply placed above ground, without the need to place the pads below the ground surface. This of course is highly desirable in that it avoids the expense of preparing footing trenches. Of course, the present system also avoids pouring concrete on site, as with conventional rectangular footings.

what is claimed is:

1. A foundation system for a building comprising a plurality of spaced vertically extending pedestals wherein said pedestals engage with said building to form a rigid foundation providing both lateral and vertical support, said pedestals comprising an upper portion to which said building is attached, a base having a substantially truncated pyramid or frusto-conical shape wherein the volume defined by said shape is substantially filled with lightweight, reinforced concrete, wherein the angle between a bottom of said base and a side of said base is between 25 degrees and 50 degrees, the bottom surface of said base being rough so as to increase the friction factor between the base and the ground on which it rests and thereby increase lateral resistance to movement, said pedestals further comprising a vertically adjustable connector between said base and said upper portion that enables each pedestal to be precisely adjusted vertically so that said upper portions of the pedestals are dead level and yet the pedestals accommodate variations in the elevation of the surface on which the bases rest, and wherein said pedestals further comprise a plate substantially parallel to said bottom and disposed near a top of said base, said plate being coupled to said vertically adjustable connector so as to transfer a load borne by said connector to said base.

2. The system of claim 1, wherein said bottom of said base of said pedestal has an area several times greater than the area of the top of said base.

3. The system of claim 2, wherein said base of said pedestal has a rectangular cavity centered on the top of said base and extending downward to the bottom of said base, said cavity for receiving said vertically adjustable connector.

4. The system of claim 3, wherein said base of said pedestal further comprises an outer square tube sized to fit snugly within said rectangular cavity, said outer square tube engaging with said vertically adjustable portion.

5. The system of claim 4, wherein said outer square tube extends from the bottom of said cavity to slightly beyond the top of said base, said outer square tube being attached to said plate between the ends of said outer square tube, said plate being perpendicular to the sides of said outer square tube and extending outward from said outer square tube into said base to provide structural support.

6. The system of claim 4, wherein said outer square tube extends the full length of said cavity, said outer square tube also having a plate attached about top end of said outer square tube, said plate fastened to and covering the top of said base excluding the area of said cavity.

7. The system of claim 4, wherein said base further comprises fastening means for attaching additional lateral support to said building.

8. The system of claim 7, wherein said fastening means is a ferrule loop insert at a substantially center position on each side of said base, said ferrule loop inserts positioned perpendicular to and inside of said base, said ferrule loop inserts used to provide added lateral support when engaged with a strut connected the chassis of said building.

9. The system of claim 7, wherein said fastening means is a series of holes in the top of said base in between said cavity and the sides of said base, said holes being adaptable to engage bolts for fastening additional lateral supports from said base to said building.

10. The system of claim 4, wherein said vertically adjustable connector further comprises a first connecting means for attaching said base to said vertically adjustable connector and a second connecting means for attaching said vertically adjustable connector to said upper portion, said first and second connecting means attached to each other.

11. The system of claim 10, wherein said first connecting means is an inner square tube sized to fit within said outer square tube and a retaining means that engages said inner and said outer square tubes to retain said inner square tube at different preset lengths within said outer tube.

12. The system of claim 10, wherein said second connecting means is a nut and bolt, said nut being attached to said first connecting means and threaded to engage said bolt, said bolt being threaded to engage said nut on a first end and having a head for mating with said upper portion.

13. The system of claim 11, wherein said upper portion further comprises a plate sized for clamping to the chassis of said building, and a retaining means for connecting said upper portion to said vertically adjustable connector, said retaining means allowing said plate to be positioned less than perfectly perpendicular to said vertically adjustable connector.

14. The system of claim 13, wherein said retaining means resists movement in the vertical directions and all 360 degrees of lateral direction.

15. The system of claim 13, wherein said upper portion is a U-shaped channel with the open end of the channel facing upwardly, said channel being connected with said plate, and further having a hole with beveled edges and said second connecting means extending through said hole in said channel, said channel for allowing said vertically adjustable connector to be positioned less than perfectly perpendicular to said plate.

16. The system of claim 15, wherein said base is constructed of reinforced concrete, said concrete permitting the prefabrication of said pedestal at off site locations.

17. A pedestal for a foundation system for a manufactured building, comprising:

a base having a substantially truncated pyramid shape with a rectangularly shaped bottom with its length considerably longer than its width; and the angle between a bottom of said base and a longer side of said base is about 45 degrees and the angle between the bottom and the shorter sides of said base is about 30 degrees, and wherein the volume defined by said shape is substantially filled with reinforced concrete.

a vertically adjustable connector connected to said base;

an upper portion for engaging said manufactured building; and a plate substantially parallel to said base bottom and disposed near a top of said base, said plate coupled to said vertically adjustable connector so as to transfer a load borne by said connector to said base.

18. The pedestal of claim 17, wherein said bottom has an area which is several times greater than the area of the top of said base.

19. The pedestal of claim 18, wherein said base further comprises distribution means to apply the weight of the manufactured building evenly over said base.

20. The pedestal of claim 19, wherein said plate is attached on the top of said base.

21. The pedestal of claim 19, wherein said plate is positioned between the top and bottom of said base.

22. The pedestal of claim 19, wherein said base further comprises a tube sized to fit said adjustable connector, said tube for receiving said adjustable connector and positioning said adjustable connector at different heights, said tube being coupled to said plate so as to transfer said load to said base.

23. A pedestal of a foundation system for a building, comprising:

a lower portion formed of one or more reinforced concrete pads, said pads having a substantially truncated shape wherein the volume defined by said shape is substantially filled with concrete, each of said pads having a combined bottom surface at least 600 square inches in area for engaging soil, wherein the angle between said surface and a side of said lower portion is between about 25 and 40 degrees;

a weight distribution frame mounted to said lower portion, said weight distribution frame retaining a tube in a vertically oriented position near the center of said lower portion;

a plate parallel to said bottom surface and disposed substantially near a top of said lower portion, said plate being coupled to said tube so as to transfer a load borne by said tube to said lower portion; and wherein said tube and said pedestal are capable of withstanding large lateral loads as well as vertical loads which increases the stability of the pedestal.

24. The pedestal of claim 23, further comprising:

an upper portion for attaching the pedestal to the building; and a vertically adjustable connector adapted to connect said upper portion to said tube of said weight distribution frame.

25. The pedestal of claim 24, wherein said lower portion, said vertically adjustable connector and said upper portion are rigidly attached together to resist any sliding or other lateral forces having a strength of less than 50% of the vertical load applied to the pedestal.

26. The pedestal of claim 24, wherein said lower portion comprises:

a first pad having a substantially truncated pyramid or frusto-conical shape;

a second pad having a substantially truncated pyramid or frusto-conical shape; and wherein said weight distribution frame connects said first and said second pads together and said frame, is connected to said tube.

27. The pedestal of claim 26, further comprising spacers attached between said first and said second pads and said frame.

28. The pedestal of claim 27, wherein said spacers are formed of heavy neoprene or plastic.

29. The pedestal of claim 27, wherein said weight distribution frame further comprises members and brackets for retaining said tube near the top center area of said lower portion.

30. The pedestal of claim 29, wherein said members of said frame extends along the top of said first and said second pads, and said brackets are connected between said members.

31. The pedestal of claim 30, wherein said members are substantially L-shaped and said brackets are C-shaped.

32. The pedestal of claim 31, wherein said tube extends perpendicular to and is attached to said brackets.

33. The pedestal of claim 32, wherein said frame is integrally formed by welding said L-shaped members, said C-shaped brackets and said tube together.

34. The pedestal of claim 33, wherein said frame is connected to said first and said second pads by mounting the L-shaped member on said first pad and mounting the other L-shaped member on said second pad using bolts.

35. The pedestal of claim 26, wherein said tube is sized to fit said adjustable connector, said tube receiving said adjustable connector and positioning said adjustable connector at different heights.

36. The pedestal of claim 35, wherein said adjustable connector further comprises a first connecting means for attaching said weight distribution frame to said adjustable connector and a second connecting means for attaching said adjustable connector to said upper portion, said first and second connecting means attached to each other.

37. The pedestal of claim 36, wherein said first connecting means is an inner square tube sized to fit within said tube and a retaining means that engages said inner tube and said tube to retain said inner square tube at different preset lengths within said tube.

38. The pedestal of claim 36, wherein said second connecting means is a nut and bolt, said nut being attached to said first connecting means and threaded to engage said bolt, said bolt being threaded to engage said nut on a first end and having a head for mating with said upper portion, said nut and said bolt providing fine and gradual adjustment in height of said adjustable connector.

39. The pedestal of claim 36, wherein said upper portion further comprises a plate sized for clamping to the chassis of said building, and a retaining means for connecting said upper portion to said vertically adjustable connector, said retaining means allowing said plate to be positioned less than perfectly perpendicular to said vertically adjustable connector.

40. A pedestal for a foundation system for a manufactured building, comprising:

a base having a substantially truncated pyramid or frusto-conical shape;

a vertically adjustable connector connected to said base;

an upper portion for engaging said manufactured building; and wherein said base has a bottom with an area which is several times greater than the area of the top of said base, said base further comprising distribution means to apply the weight of the manufactured building evenly over said base, said base further comprising a tube sized to fit said adjustable connector for receiving and positioning said adjustable connector at different heights, said pedestal including reinforcement rods in said base attached to said tube.

41. The pedestal of claim 40, wherein said reinforcement rods are positioned between the top and bottom of said base and are parallel to longitudinal sides of said base.

42. A pedestal of a foundation system for a building, comprising:

a lower portion formed of one or more concrete pads having a combined bottom surface at least 600 square inches in area for engaging soil, wherein the angle between said surface and a side of said lower portion is between about 25 and 40 degrees;

a weight distribution frame mounted to said lower portion, said weight distribution frame retaining a tube in a vertically oriented position near the center of said lower portion; and wherein said tube and said pedestal are capable of withstanding large lateral loads as well as vertical loads which increases the stability of the pedestal;

the pedestal further comprising an upper portion for attaching the pedestal to the building, and a vertically adjustable connector adapted to connect said upper portion to said tube of said weight distribution frame;

wherein said pads are frustum shaped and wherein said weight distribution frame comprises reinforcement rods within said pad and a plate that rests on a top of said pad, said plate and said rods being attached to said tube.

* * * * *